United States Patent [19]

Harwath

[11] Patent Number: 4,941,853

[45] Date of Patent: Jul. 17, 1990

[54] ELECTRICAL CONTACT TORSION BAR SYSTEMS

[75] Inventor: Frank A. Harwath, Downers Grove, Ill.

[73] Assignee: Molex Incorporated, Lisle, Ill.

[21] Appl. No.: 406,201

[22] Filed: Sep. 12, 1989

[51] Int. Cl.[5] ..... H01R 11/22

[52] U.S. Cl. ..... 439/848; 439/286; 439/816

[58] Field of Search ..... 439/851–857, 439/284, 286, 289, 290, 293, 387, 825, 324, 848, 816

[56] References Cited

U.S. PATENT DOCUMENTS

| | | | |
|---|---|---|---|
| 3,411,127 | 11/1968 | Adams | 439/290 |
| 3,439,316 | 4/1969 | Evans . | |
| 3,786,401 | 1/1974 | Jones et al. | 439/852 |
| 3,815,081 | 6/1974 | Jones | 439/851 |
| 3,818,424 | 6/1974 | Evans | 439/852 |
| 4,735,588 | 5/1988 | Bird et al. . | |
| 4,740,180 | 4/1988 | Harwath et al. | 439/856 |

FOREIGN PATENT DOCUMENTS

| | | | |
|---|---|---|---|
| 29705 | 12/1956 | Fed. Rep. of Germany | 439/852 |
| 738017 | 5/1980 | U.S.S.R. | 439/852 |

*Primary Examiner*—David L. Pirlot

*Attorney, Agent, or Firm*—Louis A. Hecht; Stephen Z. Weiss

[57] ABSTRACT

Electrical terminals include torsion bar spring portions for maintaining ample contact forces in small sizes and with simple configurations. A male contact includes a contact portion connected by an axial torsion bar to a base portion. When the contact is mated with another contact, the contact portion is pivoted to apply a torque to the torsion bar. A female contact includes opposed and axially spaced contact portions separated by an axially extending torsion bar to which torque is applied when a mating pin contact displaces the contact portions in opposite arcuate directions.

15 Claims, 3 Drawing Sheets

ELECTRICAL CONTACT TORSION BAR SYSTEMS

FIELD OF THE INVENTION

The present invention relates to electrical terminals and more particularly to contact structures with torsion bars for maintaining electrical contact forces.

DESCRIPTION OF THE PRIOR ART

When electrical terminals are mated to make an electrical connection, it is important that a contact force be maintained for integrity of the connection over time in the face of creep, oxidation and other adverse factors. Often, the contact force is maintained by incorporating spring characteristics into the structure of the terminal.

Many conventional terminals rely on a cantilever beam system for producing the required spring characteristic. In one common arrangement, a female contact includes opposed spring arms or beams extending from a relatively fixed base structure, for example opposed sides of a relatively rigid box. Contact regions on the arms are deflected when the terminal is mated with a male contact such as a contact pin, a circuit board edge or the like. The arms are flexed apart and function as springs to maintain contact force.

Although terminals employing this general class of contact system have been widely used for many years with good results, difficulties arise due to the present trend to miniaturize electrical circuits and the terminals used in electrical circuits. In small sizes, it is difficult and expensive to form cantilever beam based spring contact systems. In addition, the limited amount of material available in miniaturized terminals makes it difficult and in some cases impossible to provide cantilever springs of sufficient size to maintain the required contact force.

Terminals have been developed that use cantilever springs in smaller and more effective ways. U.S. Pat. No. 4,735,588 discloses a spring contact system having a twist profile. A male contact member includes a plurality of parallel cantilever beams inserted into a female tubular contact with a helical interior for flexing the individual beams. U.S. Pat. No. 4,740,180 discloses a contact system in which a pair of cantilever spring arms are deflected by a male terminal having a lead-in portion and a final portion. Terminals as disclosed in these patents have many advantages, but are subject to limitations because they rely on cantilever beam springs.

One difficulty inherent with a cantilever beam spring contact system is that the amount of spring force that can be developed for a given spring size is relatively small. When a cantilever beam or similar beam is flexed, significant tensile stress is experienced in only a part of the cross section of the beam. Considered in relation to the theoretical capabilities of the material of the beam, a cantilever beam spring system is relatively inefficient even when the design is optimized.

SUMMARY OF THE INVENTION

Among the objects of the present invention are to provide a contact system for electrical terminals that is more efficient than cantilever beam based systems; to provide a contact system that is easier and more economical to make than known contact systems having similar sizes and contact forces; to provide a contact system capable of maintaining substantial contact forces even in miniature sizes; and to overcome problems and limitations experienced with known contact systems.

In brief, the objects and advantages of the invention are achieved by providing an electrical contact system having first and second electrical terminals relatively movable in an axial direction into engagement with one another. The first terminal includes a contact portion engageable with the second terminal, a reaction portion spaced in the axial direction from the contact portion and a spring portion connected between the reaction portion and the contact portion. The second terminal includes contact means engageable with the contact portion of the first terminal for displacing the contact portion relative to the reaction portion and flexing the spring portion to maintain a contact force between the contact portion and the contact means. The spring portion is a torsion bar extending at least partly in the axial direction. The contact portion is displaced in an arcuate path around an axis of rotation extending in the axial direction in response to engagement by the contact means.

BRIEF DESCRIPTION OF THE DRAWINGS

The present invention together with the above and other objects and advantages may best be understood from the following detailed description of the embodiments of the invention illustrated in the drawings, wherein.

DETAILED DESCRIPTION OF THE PREFERRED EMBODIMENT

Figures 1, 2, 3, 4, 5:
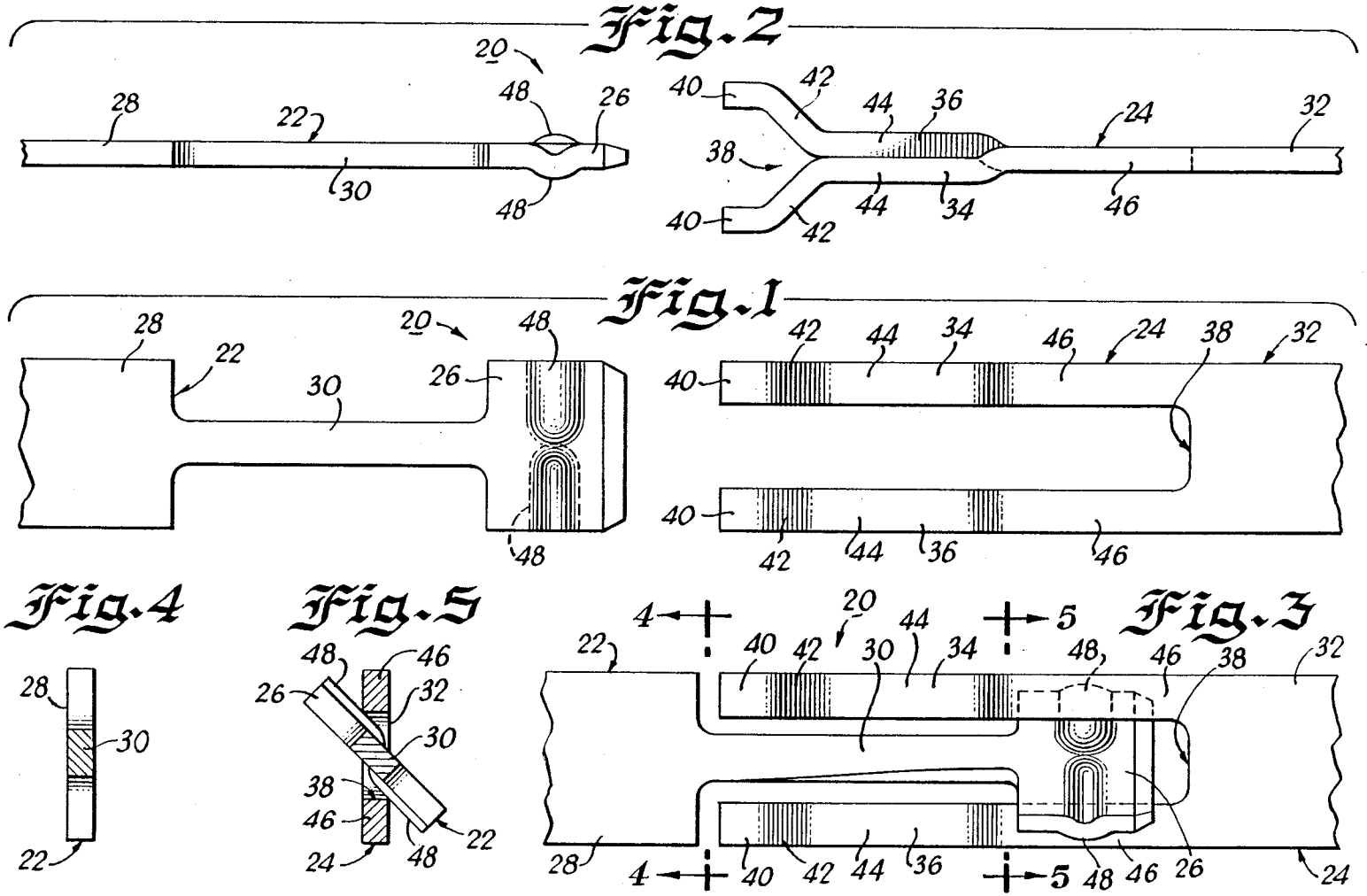
FIG. 1 is a fragmentary, top plan view of a pair of electrical terminals incorporating a contact system in accordance with the present invention and shown prior to mating of the terminals.
FIG. 2 is a side elevational view of the terminals of FIG. 1.
FIG. 3 is a view similar to FIG. 1 showing the terminals in a mated condition.
FIGS. 4 and 5 are sectional views taken respectively along lines 4—4 and 5—5 of FIG. 3.

Referring now to the drawings, FIGS. 1–5 illustrate a contact system generally designated as 20 constructed in accordance with the principles of the present invention. Contact system 20 is incorporated into a separable electrical connection made by a pair of electrical terminals 22 and 24. These terminals are moved toward one another in an axial direction to mate and to establish the electrical connection and are moved apart in the axial direction to separate and break the electrical connection. Both terminals are made by stamping and forming from planar sheet metal stock.

Terminal 22 is a male terminal and includes a contact portion 26, a base portion 28 and a spring portion 30. Terminal 24 is a female terminal and includes a base portion 32 and a pair of contact arms 34 and 36 defining a slot or aperture 38 for receiving the contact portion 26 of terminal 22.

When terminals 22 and 24 are mated as seen in FIGS. 3 and 5, contact portion 26 is received in slot 38 and makes electrical contact with arms 34 and 36 in order electrically to interconnect terminals 22 and 24. Additional rear contact structures (not shown) may extend from the bases 28 and 32 of terminals 22 and 24 for interconnection with other circuit elements or conductors or the like. Depending upon circuit requirements, these additional contact structures may be pins, posts or other types of male or female contacts of any known type. Arrays of numerous terminals 22 and 24 may be employed for simultaneous interconnection of many circuits associated with cables, printed circuit boards or other components. Arrays of the terminals 22 and 24 may be supported in or by housings or supports (not shown) to form multiple contact electrical connectors of many known types.

Spring portion 30 of terminal 22 acts as a torsion bar and is subjected to torque resulting in a twisting deformation when terminal 22 is mated with terminal 24. In order to permit this result, the base portions 28 and 32 of terminals 22 and 24 are mounted or secured in such a way that they do not rotate relative to the axial direction when the terminals are mated. With respect to terminal 22, base portion 28 is greater in width and in cross section than the spring portion 30 and functions as a reaction member when torque is applied to the torsion beam spring portion 30. Base portion 28 may be fixed in a slot or in grooves in a housing or other supporting structure. Base portion 32 of terminal 24 may be similarly secured so that relative movement during mating between the base portions 28 and 32 is limited to movement substantially in an axial direction.

When terminals 22 and 24 are mated, the contact portion 26 enters the slot 38, contacts the arms 34 and 36 and is pivoted or rotated in an arcuate path about the longitudinal axis of the terminal 22. This applies a torque to the forward end of spring portion 30 causing the spring portion to be deformed by twisting into a helical shape. This twisting is accompanied by shear stresses distributed over the length of the spring portion or torsion bar 30. The resisting torque maintains contact force between the contact portion 26 and the contact arms 34 and 36 of terminals 22 and 24.

Although they are oriented in opposition to one another, the arms 34 and 36 are similar. Each includes an entry portion 40 and a sloped guide portion 42. Portions 40 and 42 of the arms 34 and 36 are offset in different directions from the plane of the terminal base portion 32 to form an entry mouth best seen in FIG. 2 permitting the contact portion 26 of terminal 22 to be received between the entry portions 40 of the arms as the terminals are mated. Continued relative movement of terminals 22 and 24 toward one another in the axial direction brings contact portion 26 into contact with guide portions 42 and then into contact between forward displacing portions 44 of the arms 34 and 36. This results in initial rotation or arcuate movement of the contact portion 26 and the application of an initial twisting torque to the axially centered torsion beam spring portion 30.

Further relative movement of terminals 22 and 24 results in entry of the contact portion 26 between rear displacing portions 46 of arms 34 and 36 (FIG. 3). Portions 46 are coplanar and cause maximum twisting deformation of the torsion beam spring portion 30. Contact portion 26 includes oppositely directed ribs or protrusions 48 oriented to engage the arms 34 and 36 as seen in FIGS. 3 and 5 to provide relatively small contact areas and relatively high contact forces. The surfaces of arms 34 and 36 that contact the contact portion 26 and displace it in an arcuate direction may be rounded or chamfered to avoid a sharp edge contact if desired.

Terminal 22 is an easily and economically manufactured shape, yet provides ample contact forces even when the terminal is supplied in miniature sizes. The contact forces maintained in the torsion bar spring portion 30 depend upon factors including the length and cross section of the portion 30, the torsional angle through which the ends of the portion 30 are rotated relative to one another (see FIGS. 4 and 5) and the material from which it is made. Metals customarily used for stamped and formed electrical terminals, such as beryllium copper, provide a modulus of elasticity in shear suitable for achieving the desired contact forces. The section of beam portion 30 is selected to have the desired polar moment of inertia. In the illustrated arrangement, the beam portion 30 is rectangular because this form is easily made in stamping and forming processes and provides the desired result. If desired, circular or other sectional shapes could be employed.

In the embodiment of the invention illustrated in FIGS. 1–5 of the drawings, the arms 34 and 36 of the female contact 24 may flex in the manner of cantilever beams, but this resilience is not important to an understanding of the present invention. The terminal 22 may be employed with a functionally rigid female terminal. If desired, a torsion beam spring portion may be employed in a female terminal like the terminal 24 by forming a torsion bar like the spring portion 30 between the contact arms and a rotationally fixed terminal base.

Figure 8:
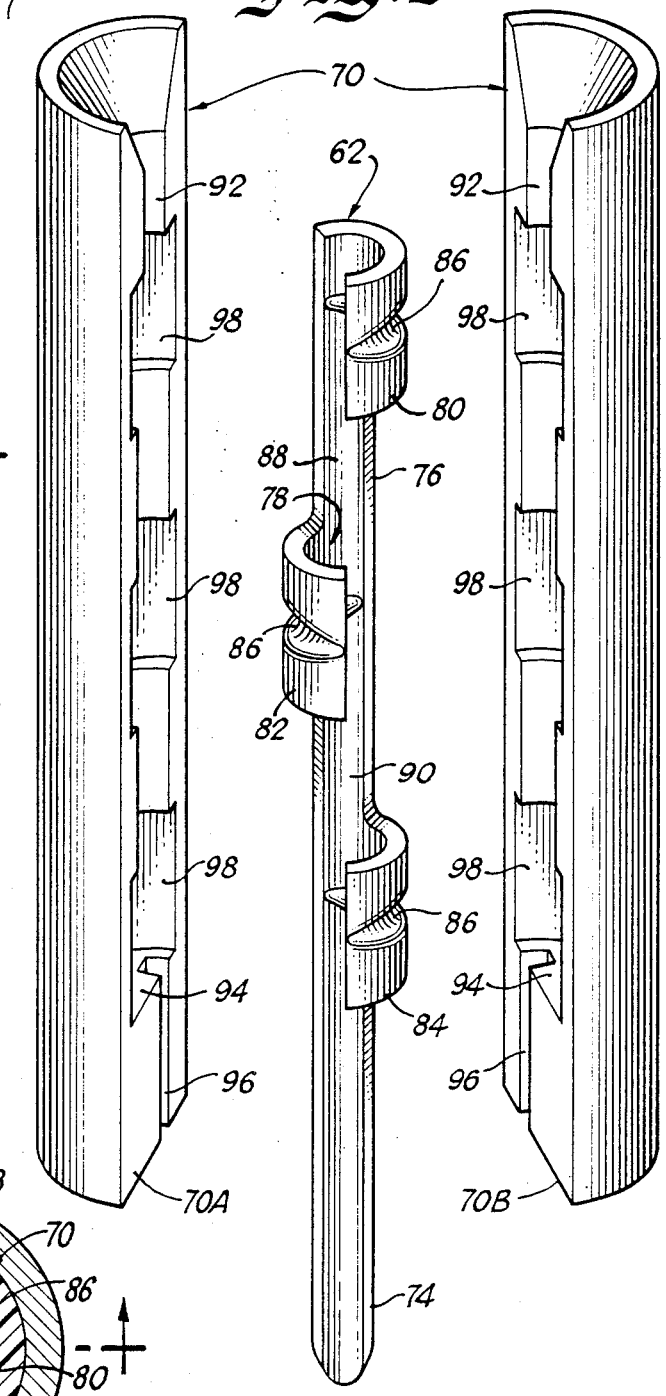
FIG. 8 is an exploded perspective view of the terminal and sleeve components of the connector of FIG. 6.
Figure 9:
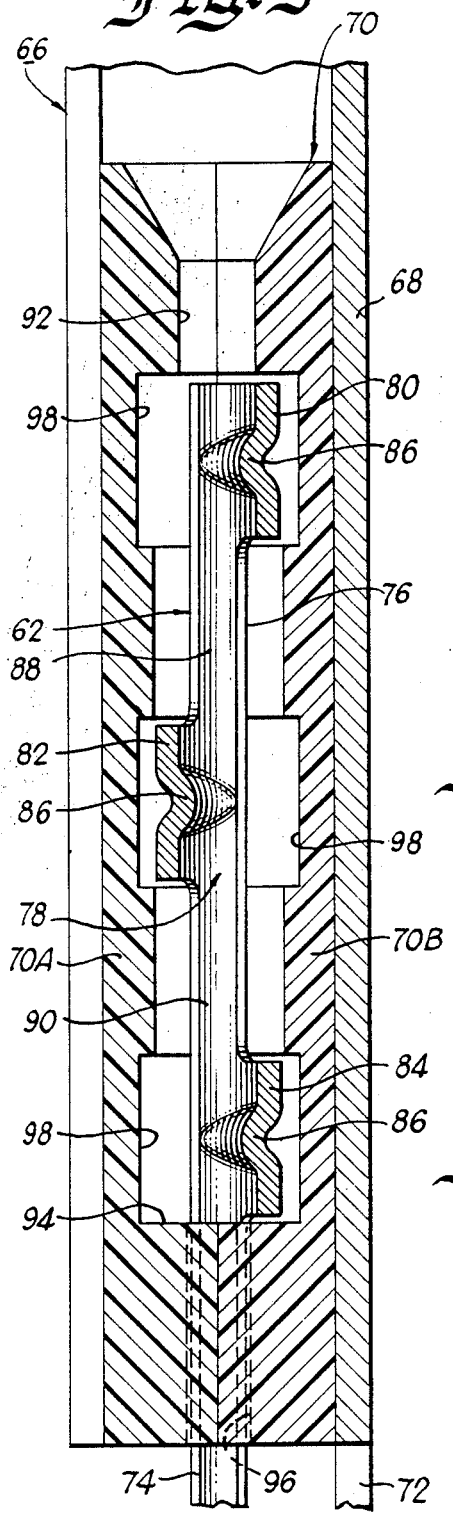
FIG. 9 is a sectional view of the connector taken along the line 9—9 of FIG. 7.
Figure 10:
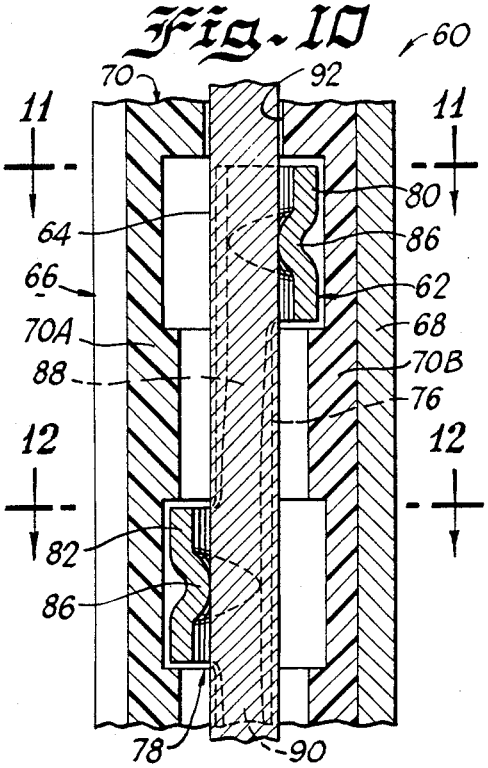
FIG. 10 is a fragmentary sectional view similar to part of FIG. 9 showing the connector when mated with a pin contact.
Figure 11:
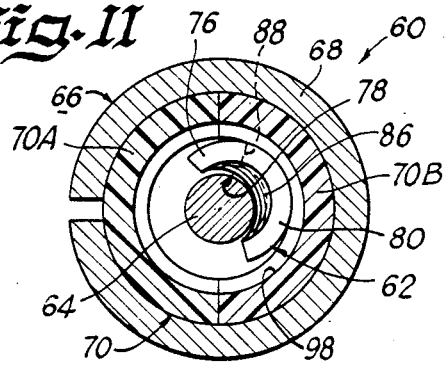
FIGS. 11 and 12 are sectional views taken respectively along lines 11—11 and 12—12 of FIG. 10.
Figure 12:
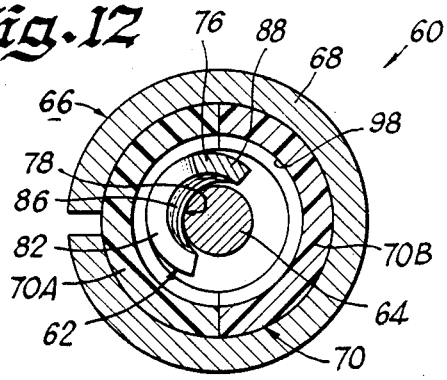

Having reference now to FIGS. 6–12, there is illustrated a contact system generally designated as 60 (FIGS. 10–12). Contact system 60 is an embodiment of the present invention in which the principles of the invention are applied to a female terminal 62 rather than to a male terminal such as the terminal 22 described above. Terminal 62 is movable in an axial direction relative to a male pin contact or terminal 64 in order to mate with terminal 64 and establish an electrical connection between the terminals.

Figure 6:
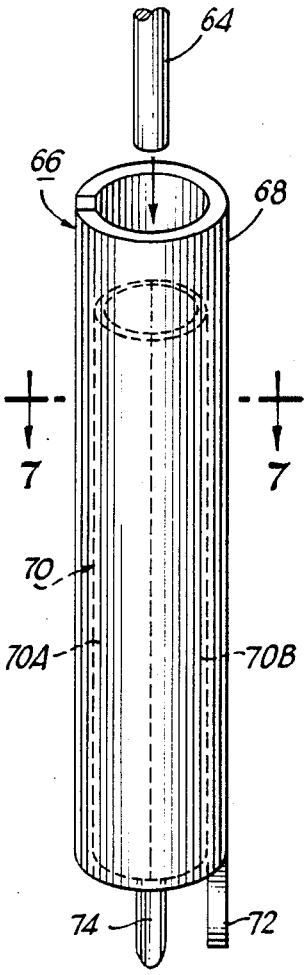
FIG. 6 is a perspective view of an electrical connector including a female terminal incorporating a contact system that is an alternative embodiment of the present invention.
Figure 7:
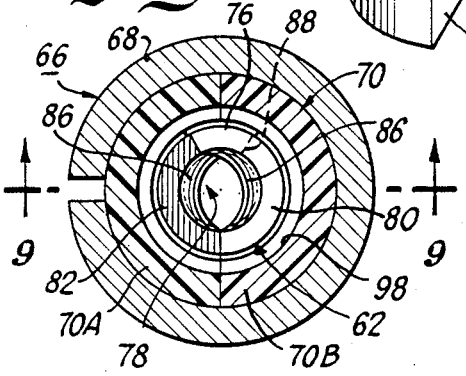
FIG. 7 is a sectional view on an enlarged scale taken along the line 7—7 of FIG. 6.

Terminal 62 is the central contact of a miniaturized coaxial connector designated as a whole as 66 and seen in FIGS. 6 and 7. Connector 66 includes an outer sleeve terminal 68 concentric with the axis of connector 66. An insulating sleeve 70 is captured concentrically between the terminals 62 and 68 and positions the terminal 62 at the axis of the connector. As best seen in FIG. 8, the sleeve 70 includes two halves 70A and 70B symmetrical about a diameter of the terminal, although other arrangements may be employed if desired.

Connector 66 may be mounted upon a printed circuit board. The outer sleeve terminal 68 includes a rearwardly extending pin contact 72 and the female terminal 62 includes a similar rearwardly extending pin contact 74 (FIGS. 6, 8 and 9). Connector 66 may be supported at the surface of a printed circuit board with pin contacts 72 and 74 extending through holes in the board and connected by soldering to conductive paths. A mating coaxial cable end connector including pin contact 64 at its axis may be mated with connector 66 to establish electrical connections between a cable or other component and conductive regions of the printed circuit board.

Terminal 62 includes a spine or stalk portion 76. As appears in FIG. 8, the spine 76 extends continuously from pin contact 74 at the rear of the terminal to the forward end of the terminal. Spine 76 extends in the axial direction and is offset laterally or radially from the central axis of the terminal in order to provide clearance for the pin contact 64 as it moves along a pin receiving path 78.

At axially spaced positions along the length of the spine 76, three similar contact wings 80, 82 and 84 are provided. Alternate wings extend in opposite lateral directions from spine 76, with the outer two wings 80 and 84 extending in one direction and the central wing 82 extending in the opposite direction. Each wing 80, 82 and 84 cooperates in defining and extends partly around the pin receiving path 78. The wings 80, 82 and 84 are provided with ribs 86 serving to stiffen the wings and to define small area contact surfaces for engaging the pin contact 64.

Terminal 62 is mated with pin contact 64 when contact 64 is moved in the axial direction into path 78 and into contact with the ribs 86 of the wings 80, 82 and 84. In the mated condition shown in FIGS. 10–12, the wings are moved arcuately or radially outward, in effect pivoting in opposite directions around the spine portion 76. Between adjacent pairs of contact wings 80, 82 and 84, segments of the spine portion 76 define torsion bar spring portions 88 and 90. Ribs 86 render the wings relatively rigid, and the displacement of the wings applies torque to the torsion bar spring portions 88 and 90 causing them to twist and deform into helical shapes.

A comparison of FIGS. 7 and 11 indicates the arcuate outward movement of contact wing 80 resulting from contact of the pin contact 64 with rib 86 of wing 80. The movement of wing 84 is similar to the movement of wing 80. In FIG. 12 it can be seen that the wing 82 is moved in the opposite direction by the contact pin 64. The torsion angle resulting from relative rotation of the opposite ends of the torsion beam spring portion 88 appears from a comparison of FIGS. 11 and 12. The twisting deformation of the torsion beam spring portion 88 into a helical shape is seen in broken lines in FIG. 10.

Considering the forward pair of contact wings 80 and 82, together with the torsion bar spring portion 88, as a mechanical system, one of the wings such as wing 80 may be considered to be a contact portion applying torque to the spring portion 88, and the other contact wing such as wing 82 may be considered to be a reaction member. When the wings are displaced by contact of ribs 86 with the surface of the contact pin 64, shear stress is distributed along the length of the torsion bar spring portion 88 and the resisting torque is applied to the contact pin by way of the ribs 86 to maintain contact force or contact pressure at the contact interface. The rear pair of contact wings 82 and 84 together with the torsion bar spring portion 90 functions as a similar mechanical system. The use of three wings provides the redundancy of three points of contact and provides a contact interface with forces in balance. More or fewer contact wings may be used. As with the torsion bar spring portion 30 of the terminal 22 described above, the section and length of the portions 88 and 90 are selected to achieve the desired spring force with the material used for the terminal. Substantial forces are possible with an easily manufactured, simple and compact structure that may be very small in size. For example, a preferred embodiment of the terminal 62 mates with a pin contact 64 having a diameter of 0.010 inch.

Sleeve 70 as illustrated in FIG. 8 is provided with an internal configuration cooperating with the shape of the terminal 62. A reduced diameter neck portion 92 at the forward end of the sleeve captures the terminal 62 and serves to guide the pin contact into and along the pin receiving path 78. A shoulder 94 at the rear of the sleeve 70 also assists in holding the terminal 62. A recess or passage 96 at the rear of the sleeve 70 permits the pin contact portion 76 to extend to the exterior of the connector 66 and orients the terminal 62. Annular grooves 98 are axially spaced along the interior of sleeve 70 to receive the wings 80, 82 and 84 as they are displaced by the pin contact 64.

I claim:

1. An electrical contact system comprising:

first and second electrical terminals relatively movable in an axial direction into engagement with one another;

said first terminal including a contact portion engageable with said second terminal, a reaction portion spaced in the axial direction from said contact portion and a spring portion connected between said reaction portion and said contact portion; and said second terminal including contact means engageable with said contact portion of said first terminal for displacing said contact portion relative to said reaction portion and flexing said spring portion to maintain a contact force between said contact portion and said contact means;

the contact system being characterized by:

said spring portion comprising a torsion bar extending at least partly in the axial direction;

said torsion bar coinciding with the central axis of said first terminal; and said contact portion being a blade symmetrical about said central axis and being displaced in an arcuate path around an axis of rotation extending in said axial direction in response to engagement by said contact means.

2. An electrical contact system as claimed in claim 1 wherein said first terminal is a male terminal.

3. An electrical terminal as claimed in claim 1 wherein said reaction portion is a base portion of said first terminal, and means constraining said base portion to move substantially only in said axial direction.

4. An electrical terminal as claimed in claim 1 wherein said first terminal is a female terminal.

5. An electrical terminal as claimed in claim 1 wherein said reaction portion is a second contact portion engaged by said contact means, said second contact portion being displaced in an arcuate path in opposition to said displacement of said first contact portion in response to engagement by said contact means.

6. A stamped and formed electrical terminal comprising a contact portion, a reaction portion spaced in an axial direction from said contact portion and a torsion bar spring portion extending in said axial direction between said contact and reaction portions, said torsion bar spring portion having a smaller cross section than said contact and reaction portions and maintaining a contact force when subjected to twisting deformation in response to opposed relative arcuate movement of said contact and reaction portions;

said reaction portion being a terminal base portion supported to resist torque resulting from arcuate movement of said contact portion;

said torsion bar spring portion coinciding with the central axis of said terminal; and said contact portion being a blade symmetrical about said central axis.

7. The terminal of claim 6 wherein said reaction portion is a second contact portion spaced laterally from said first contact portion, said first and second contact portions being disposed on opposite sides of a contact receiving path.

8. The terminal of claim 7 wherein said torsion bar contact portion is disposed to the side of said terminal receiving path.

9. An electrical contact system for electrical connections comprising:

first and second electrical terminals relatively movable in an axial direction into engagement with one another;

said first terminal including a base portion, a contact portion engageable with said second terminal and a spring portion connected between said base portion and said contact portion;

means constraining said base portion for movement substantially only in said axial direction; and said second terminal including contact means engageable with said contact portion of said first terminal for displacing said contact portion and flexing said spring portion to create a contact force between said contact portion and said contact surface means;

the contact system being characterized by:

said spring portion comprising a torsion bar extending at least partly in said axial direction;

said torsion bar coinciding with the central axis of said first terminal and said contact section being symmetrical around said central axis; and said contact portion being pivoted around an axis of rotation extending in said axial direction to apply torque to said torsion bar in response to engagement by said contact surface means.

10. An electrical contact system as claimed in claim 9, said contact portion comprising a contact blade extending radially in opposite directions from said central axis, said contact means including two contact arms engageable with opposite sides of said blade at opposite sides of said central axis.

11. An electrical contact system as claimed in claim 10, said arms defining a slot for receiving said blade, said slot including an entry portion and a contact displacement portion.

12. An electrical contact system as claimed in claim 11 further comprising ribs formed on said blade for engaging said arms.

13. A female electrical terminal adapted to mate with a male pin contact having a given diameter when the pin is moved relative to the terminal along a pin receiving path in the direction of the axis of the terminal, said terminal comprising:

a spine portion extending in the axial direction along the side of the pin receiving path;

a plurality of axially spaced contact wings alternately projecting from opposite sides of said spine portion and extending around opposite sides of the pin receiving path;

the diametric spacing between successive contact wings being less than the pin diameter so that the wings are pivoted when the pin contact is in the pin receiving path;

a torsion bar segment along said spine portion between axially adjacent contact wings; and said contact wings being pivoted about an axis of rotation extending in said axial direction to apply torque to said torsion bar segment in response to engagement by said male pin contact.

14. A female electrical terminal as claimed in claim 13 comprising three of said contact wings and two of said torsion bar segments.

15. A female electrical terminal as claimed in claim 13 each said contact wing including a rib for limiting terminal contact area.

* * * * *